US006062154A

United States Patent [19]

Ito

[11] Patent Number: 6,062,154

[45] Date of Patent: May 16, 2000

[54] MOUNTING ASSEMBLY FOR WATERCRAFT STEERING OPERATOR

[75] Inventor: Kenji Ito, Shizuoka, Japan

[73] Assignee: Yamaha Hatsudoki Kabushiki Kaisha, Japan

[21] Appl. No.: 09/105,189

[22] Filed: Jun. 26, 1998

[30] Foreign Application Priority Data

Jun. 26, 1997 [JP] Japan ..... 9-170736

[51] Int. Cl.[7] ..... B63C 7/00; B63H 25/00

[52] U.S. Cl. ..... 114/55.57; 114/55.5; 114/144 R

[58] Field of Search ..... 114/55.5, 55.52, 114/55.53, 55.57, 154, 151, 144 R, 343, 160; 440/40; 74/480 B, 491

[56] References Cited

U.S. PATENT DOCUMENTS

| | | | |
|---|---|---|---|
| 1,891,208 | 12/1932 | Schuetz | 74/480 R |
| 2,257,613 | 9/1941 | Mannfolk | 114/154 |
| 3,208,300 | 9/1965 | Morse | 74/480 R |
| 4,141,309 | 2/1979 | Halboth | 115/70 |
| 4,726,311 | 2/1988 | Niina | 114/144 R |
| 4,986,208 | 1/1991 | Kobayashi | 114/270 |
| 5,619,950 | 4/1997 | Ikeda | 114/363 |
| 5,622,132 | 4/1997 | Mardikian | 114/144 R |

OTHER PUBLICATIONS

Yamaha Motor Company Service Manual. Handle Column section, pp. 8–5 and 8–6, 1995.

SeaDoo Shop Manual, Section 09: Steering System, pp. 09–01–1 through 09–05–4, 1997.

*Primary Examiner*—S. Joseph Morano
*Assistant Examiner*—Patrick Craig Muldoon
*Attorney, Agent, or Firm*—Knobbe, Martens, Olson & Bear, LLP

[57] ABSTRACT

An improved mounting assembly for a steering shaft on a watercraft, which increases the strength and stability of the steering assembly while significantly reducing the manufacturing complexity of the watercraft. The mounting assembly comprises an elongated body having at least a first and second bearing surface, these bearing surfaces rotatably supporting the steering shaft within the elongated body. The elongated body is further attached to a mounting flange, with the mounting flange being attached to the steering column platform which is secured to the upper or lower hull of the watercraft. The disclosed steering operator mounting assembly further significantly reduces or eliminates the corrosive effects of water and/or salt on the components of the steering assembly most susceptible to such corrosion, such as the bowden-wire cable assembly.

31 Claims, 10 Drawing Sheets

MOUNTING ASSEMBLY FOR WATERCRAFT STEERING OPERATOR

BACKGROUND OF THE INVENTION

1. Field of the Invention

This invention relates to the field of small watercraft and, more particularly, to a steering shaft mounting assembly for use on a small watercraft.

2. Description of Related Art

Personal watercraft have become popular in recent years. This type of watercraft is sporting in nature; it turns swiftly, is easily maneuverable, and accelerates quickly. Personal watercraft today commonly carry one rider and one or two passengers.

A relatively lightweight, small hull of the personal watercraft defines an engine compartment below a rider's area. An internal combustion engine frequently lies within the engine compartment in front of a tunnel formed on the underside of the watercraft hull. the tunnel. An impeller shaft commonly extends between the engine and the propulsion device for this purpose. Such small watercraft today are capable of traveling at high rates of speed.

Typically, a steering operator or column is provide in front of a straddle-type seat which allows the driver of the watercraft to control the watercraft's speed and direction. This steering operator generally incorporates an elongated cylindrical steering shaft, which includes handle bars at its upper end and a bowden-wire cable connector at its lower end. The steering shaft for a small watercraft is typically rotatably secured to the upper deck of the watercraft by two or more rotatable couplings or bearings, which secure the steering shaft in place yet allow it to freely rotate through a defined range of travel. This arrangement, however, necessitates multiple support locations for the couplings and associated mounting hardware. Moreover, the assembly of such a steering operator on the watercraft is a rather time-intensive process requiring skilled personnel.

Because the driver of the watercraft is grasping the handle bars to maneuver the watercraft, the steering shaft and handle bars typically become an auxiliary support for the watercraft driver, especially during violent maneuvers such as hard acceleration/deceleration of the watercraft and/or sharp turns. Such maneuvering greatly increases the torque and stresses experienced by the steering operator and the steering shaft supports, and thus necessitates that the steering operator be sufficiently strong and well supported to withstand such stresses.

In addition, because the steering shaft is traditionally mounted inside the hull of the watercraft, much of the steering assembly, including portions of the bowden-wire assembly, are exposed to water in the hull, which can cause significant deterioration to the steering assembly and bowden-wire assembly, especially in salt-water environments.

SUMMARY OF THE INVENTION

Accordingly, the present invention involves the recognition of a need in the art for a steering operator mounting assembly which provides sufficient support for the steering shaft, yet reduces the complexity of the watercraft assembly operation and reduces or eliminates corrosive deterioration of the steering assembly and bowden-wire components.

One aspect of the present invention thus involves a small watercraft comprising a steering column platform and a mounting assembly for a steering shaft. The mounting assembly comprises an elongated body having at least first and second bearing elements. These bearing elements rotatably supporting the steering shaft within the elongated body. The elongated body is further attached to a mounting flange, with the mounting flange being attached to the steering column platform which is secured to either the upper or lower hull of the watercraft.

The disclosed mounting arrangement permits pre-assembly of the steering shaft mounting assembly at a location remote from the watercraft hull, with final incorporation of the steering operator mounting assembly into the watercraft requiring minimal assembly. This greatly reduces the complexity of the watercraft assembly operation, and significantly reduces assembly time and costs associated with assembly of the watercraft. In addition, various components of the mounting assembly shield critical components of the steering operator assembly from the corrosive effects of water and/or salt located in the bilge of the watercraft, thereby reducing the deterioration of such critical components of the steering operator assembly and the bowden-wire cable assembly.

In accordance with an additional aspect of the present invention, a steering operator mounting assembly is provided which allows the steering operator mounting assembly to be utilized on a watercraft having a substantially horizontal upper deck surface in the proximity of the desired steering operator location. This arrangement allows the design of the watercraft hull to be simplified, and also permits the reduction of the size of the steering operator mounting assembly, thereby reducing hull-space requirements as well as raw material requirements for manufacturing the steering operator mounting assembly. Furthermore, the relative angle between the longitudinal axis of the steering shaft and the mounting bracket may be varied to allow incorporation of the disclosed steering shaft mounting assembly into watercraft having an upper deck or steering column platform of virtually any orientation.

In accordance with an additional aspect of the present invention, a steering operator mounting assembly is provided which incorporates a reduced number of component parts. This further reduces the manufacturing complexity of the steering operator mounting assembly, thus further reducing total manufacturing cost for the watercraft.

DESCRIPTION OF THE DRAWINGS

These and other features of the invention will now be described with reference to the drawings of preferred embodiments that are intended to illustrate and not to limit the invention, and in which.

DETAILED DESCRIPTION OF PREFERRED EMBODIMENTS OF THE INVENTION

Figure 1:
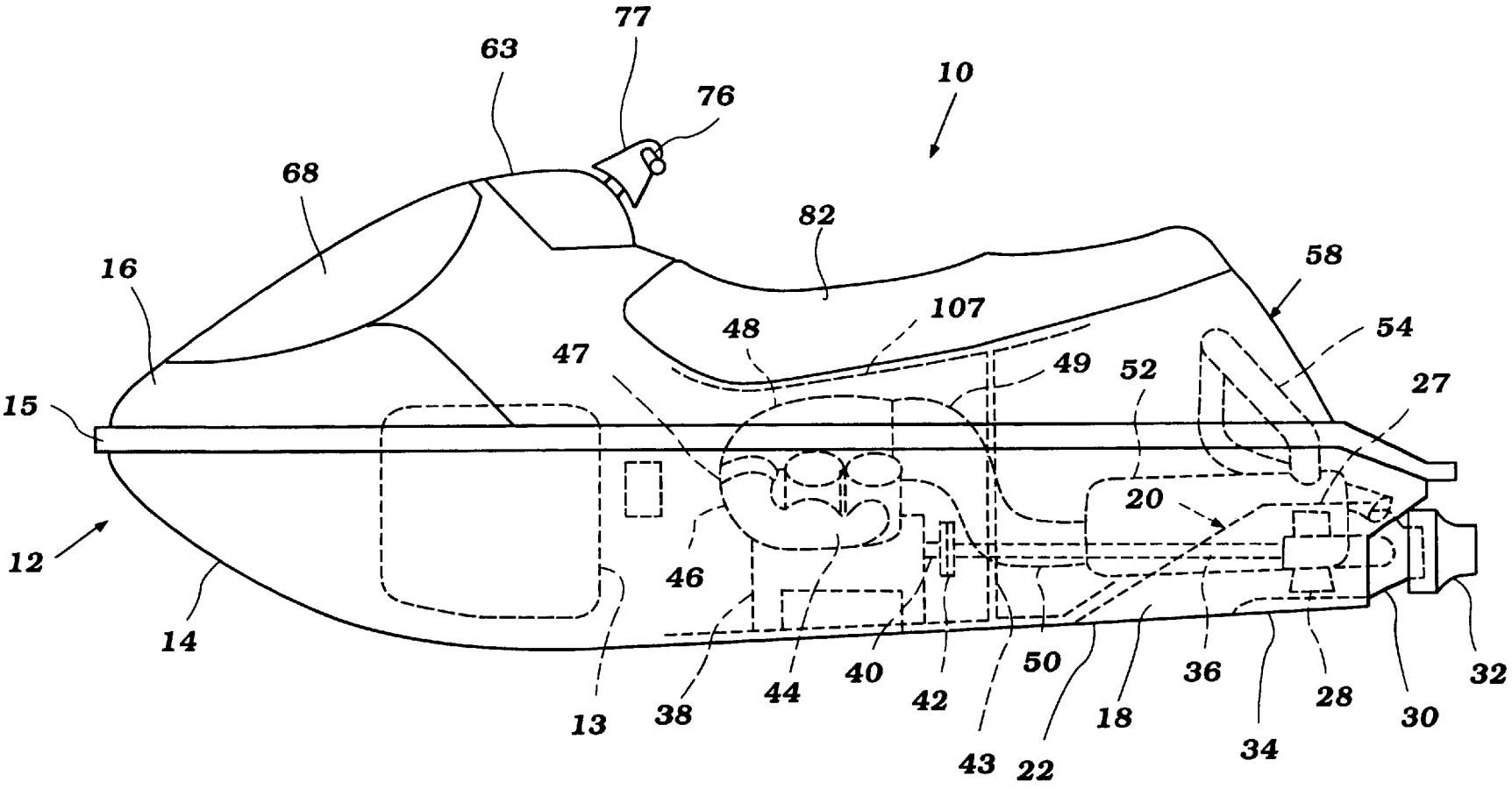
FIG. 1 is a partial sectional side elevational view of a personal watercraft including a steering operator mounting assembly configured in accordance with a preferred embodiment of the present invention, with various internal components of the watercraft illustrated in phantom.
Figure 2:
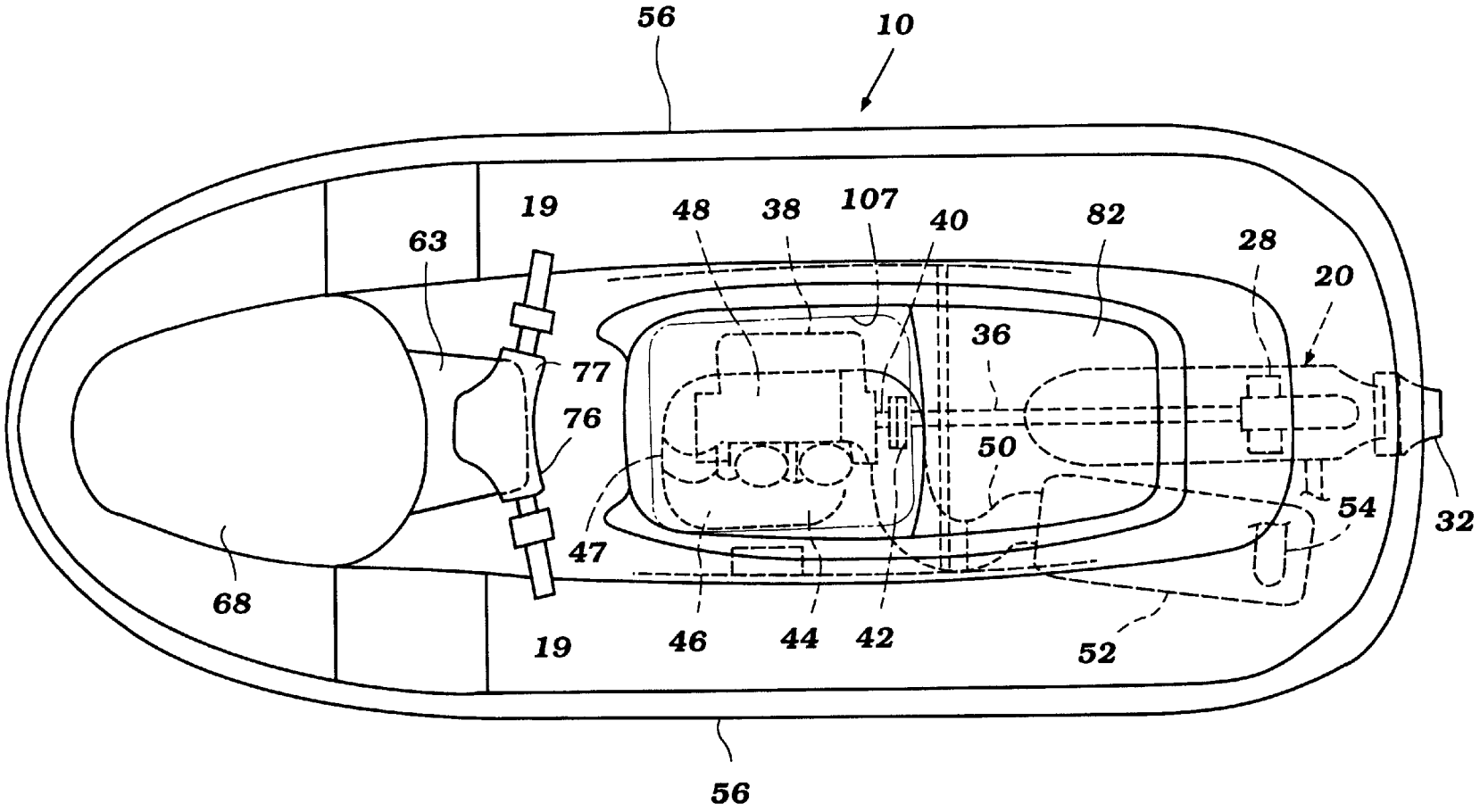
FIG. 2 is a top plan view of the watercraft of FIG. 1, with various internal components illustrated in phantom.

Several embodiments of a steering operator mounting assembly for a watercraft are disclosed herein. Each of these embodiments employ the same basic concepts characteristic of the improved features of the steering operator mounting assembly, namely a system that provides sufficient strength and rigidity to the steering operator while reducing the manufacturing complexities of the watercraft and the corrosive deterioration of bowden-wire components.

The present steering operator mounting assembly has particular utility for use with personal watercraft, and thus, the following describes the steering operator mounting assembly in the context of a personal watercraft. This environment of use, however, is merely exemplary. The present steering operator mounting assembly can be readily adapted by those skilled in the art for use with other types of watercraft as well, such as, for example, but without limitation, small jet boats and the like.

With initial reference to the embodiment illustrated in FIGS. 1–5, the watercraft 10 includes a hull 12 that is formed by a lower hull section 14 and an upper deck section 16. The hull sections 14, 16 are formed of a suitable material such as, for example, a molded fiberglass reinforced resin or plastic. The lower hull section 14 and the upper deck section 16 are fixed to each other around the peripheral edges 15 in any suitable manner.

The lower hull 14 is designed such that the watercraft 10 planes or rides on a minimum surface area of the aft end of the lower hull 14 in order to optimize the speed and handling of the watercraft 10 when up on plane. For this purpose, the lower hull section generally has a V-shaped configuration formed by a pair of inclined sections that extend outwardly from the keel line to outer chines (not shown). The inclined sections extend longitudinally from the bow toward the transom of the lower hull 14 and extend outwardly to side walls of the lower hull. The side walls are generally flat and straight near the stern of the lower hull and smoothly blend towards the longitudinal center of the watercraft at the bow. The lines of intersection between the inclined section and the corresponding side wall form the outer chines of the lower hull section.

Toward the transom of the watercraft, the incline sections of the lower hull extend outwardly from a recessed channel or tunnel 18 that extends upward toward the upper deck 16. The tunnel 18 has a generally parallelepiped shape and opens through the rear of the transom of the watercraft 10.

In the illustrated embodiment, a jet pump unit 20, which is located in a pump chamber 27 propels the watercraft 10. The jet pump unit 20 is mounted within the tunnel 18 formed on the underside of the lower hull section by a plurality of bolts. An intake duct 22 of the jet pump unit 20 defines an inlet opening that opens into the tunnel 18. This tunnel leads to an impeller housing in which the impeller 28 of the jet pump 20 operates. An impeller duct assembly, which acts as a pressurization chamber, delivers the water flow from the impeller housing to a discharge nozzle housing 30. A pair of vertically extending pivot pins (not shown) supports a steering nozzle 32 at the downstream end of the discharge nozzle.

A ride plate 34 covers a portion of the tunnel 18 behind the inlet opening to enclose the pump chamber 27 and the nozzle assembly 30 within the tunnel 18. In this manner, the lower opening of the tunnel 18 is closed to provide in part a planing surface for the watercraft.

An impeller shaft 36 supports the impeller 28 within the pump chamber 27. The aft end of the impeller shaft 36 is suitable supported and journalled within the pump chamber in a known manner. The impeller shaft 36 extends in the forward direction through a front wall of the tunnel 18

The lower hull portion 14 principally defines the engine compartment. Except for some conventional air ducts (not shown), the engine compartment is normally substantially sealed so as to enclose an engine and the fuel system of the watercraft 10 from the body of water in which the watercraft is operated.

An internal combustion engine 38 of the watercraft powers the impeller shaft 36 to drive the impeller 28 of the jet pump unit 20. The engine 38 is positioned within the engine compartment and is mounted centrally within the hull 12. Vibration-absorbing engine mounts (not shown) secure the engine 38 to the lower hull portion 14 in a known manner.

In the illustrated embodiment, the engine 38 includes two in-line cylinders and operates on a two-stroke, crankcase compression principle. The engine 38 is positioned such that the row of cylinders lies parallel to a longitudinal axis of the watercraft 10, running from bow to stern. This engine type, however, is merely exemplary. Those skilled in the art will readily appreciate that the present steering operator support mounting assembly can be used with any of a variety of engine types having other number of cylinders, having other cylinder arrangements and operating on other combustion principles (e.g., four-stroke principle).

A cylinder block and a cylinder head assembly desirably form the cylinders of the engine. A piston reciprocates within each cylinder of the engine 38 and together the pistons drive an output shaft 40, such as a crankshaft, in a known manner. A connecting rod links the corresponding piston to the crankshaft 40. The corresponding cylinder bore, piston and cylinder head of each cylinder forms a variable-volume chamber, which at a minimum volume defines a combustion chamber.

The crankshaft 40 desirably is journalled with a crankcase, which is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber. Each crankcase chamber also communicates with a charge former of an induction system through a check valve (e.g., a reed-type valve). The induction system receives fuel from a fuel tank 13, which is positioned within the hull 12, and transfers this fuel to a carburetor (not shown) which produces the fuel charge delivered to the cylinders in a known manner. Because the internal details of the engine 38, the induction system and details of the fuel supply system desirably are conventional, a further description of these components is not believed necessary to understand and practice the invention.

As seen in FIG. 1, a coupling 42 interconnects the engine crankshaft 40 to the impeller shaft 36. A bearing assembly (not shown), which is secured to the bulkhead 43, supports the impeller shaft 36 behind the shaft coupling 42.

An exhaust system is provided to discharge exhaust byproducts from the engine 38 to the atmosphere and/or to the body of water in which the watercraft 10 is operated. The exhaust system includes an exhaust manifold 44 that is affixed to the side of the cylinder block and which receives exhaust gases from the variable-volume chambers through exhaust ports in a well-known manner.

An outlet end of the exhaust manifold communicates with a C-shaped pipe section 46. This C-pipe 46 includes an inner tube that communicates directly with the discharge end of the exhaust manifold. An outer tube surrounds the inner tube to form a coolant jacket between the inner and outer tubes. Although not illustrated, the C-pipe 46 includes an inlet port positioned near its inlet end. The inlet port communicates with a water jacket of the engine 38.

The outlet end of the C-pipe 46 communicates with an expansion chamber 48. In the illustrated embodiment, the expansion chamber has a tubular shape in which an expansion volume is defined within an annular, thick wall. Coolant jacket passages extend through the expansion chamber wall and communicate with the coolant jacket of the C-pipe 46.

A flexible coupling 47 connects the outlet end of the C-pipe 46 to the inlet end of the expansion chamber 48. The flexible coupling 47 also can include an outlet port that communicates with an internal coolant passage within the flexible coupling. The coolant passage places the coolant jacket and the coolant passages in communication.

The outlet end of the expansion chamber 48 is fixed to a reducer pipe 49 that tapers in diameter toward its outlet. The pipe has a dual shell construction formed by an inner shell that defines an exhaust flow passage. The expansion volume communicates with this passage.

An outer shell is connected to the inner shell and defines a cooling jacket about the inner shell of the reducer pipe. The coolant jacket passages of the expansion chamber communicate with the coolant jacket of the pipe to discharge a portion of the coolant with the exhaust gases.

If desired, a catalyzer can be disposed within the space defined at the mating ends of the expansion chamber and the reducer pipe. For instance, the catalyzer can include an annular shell supporting a honeycomb-type catalyst bed. The catalyst bed is formed of a suitable catalytic material such as that designed to treat and render harmless hydrocarbons, carbon monoxide, and oxides of nitrogen. An annular flange supports the annular shell generally at the center of the flow path through the expansion chamber volume. In this manner, all exhaust gas flow through the expansion chamber passes through the catalyst bed. The annular flange can be held between outlet end of the expansion chamber and the inlet end of the reducer pipe.

The lower section of the reducer pipe includes a downwardly turned portion that terminates at the discharge end. The inner shell stops short of the outer shell such that the water flow through the water jacket merges with the exhaust gas flow through the exhaust passage at the discharge end.

A flexible pipe 50 is connected to the discharge end of the reducer pipe and extends rearward along one side of the watercraft hull tunnel 18. The flexible conduit 50 connects to an inlet section of a water trap device 52. The water trap device 52 also lies within the watercraft hull 12 on the same side of the tunnel 18.

The water trap device 52 has a sufficient volume to retain water and to preclude the back flow of water to the expansion chamber 48 and the engine 38. Internal baffles within the water trap device 52 help control water flow through the exhaust system.

An exhaust pipe 54 extends from an outlet section of the water trap device 52 and wraps over the top of the tunnel 18 to a discharge end. The discharge end desirably opens into the tunnel 18 at an area that is close to or actually below the water level with the watercraft 10 floating at rest on the body of water.

The upper deck 16 and the lower hull portion 14 together define a pair of raised gunnels 56 positioned on opposite sides of the aft end of the upper deck 16. The raised gunnels 56 define a pair of foot areas 19 that extend generally longitudinally and parallel to the sides of the watercraft 10. In this position, the operator and any passengers sitting on the watercraft 10 can place their feet in the foot areas 19 with the raised gunnels 56 shielding the feet and lower legs of the riders. A non-slip (e.g., rubber) mat desirably covers the foot areas 19 to provide increased grip and traction for the operator and the passengers.

Toward the forward end of the watercraft, a storage box 62 is formed in the upper deck 16 in front of the steering operator mounting assembly 76. The storage box 62 is covered by a storage cover 68, which abuts against the upper deck 16, sealing the storage box 62 in a watertight manner well known in the art. In the disclosed embodiment, the storage cover 68 is secured to the upper deck 16 by a lock mechanism 21.

As can be best seen in FIGS. I and 3, a protective cowling 63 is positioned on the upper deck 16 around the steering operator mounting assembly 76. This protective cowling is secured to the upper deck 16 by one or more bolts (not shown), and serves to improved the streamlined aesthetic appearance of the steering operator and to reduce the amount of water contacting the upper mounting flange 80.

Farther towards the aft end of the watercraft, a seat pedestal 58 rises above the foot areas. An elongated seat 82 is positioned above the pedestal. An access opening 107 is formed in the upper deck 16 underneath the seat 82. The access opening 107 opens into the engine compartment formed within the hull 12. A conventional latch or similar mechanism (not shown) releasably secures the elongated seat to the pedestal 58, thereby sealing the access opening in a watertight manner.

The personal watercraft 10 so far described represents only an exemplary watercraft on which the present steering operator mounting assembly can be employed. A further description of the personal watercraft 10 is not believed necessary for an understanding and an appreciation of the present invention.

The steering operator mounting assembly comprises an elongated body having two or more bearing elements which rotatably support the steering shaft. In the embodiments illustrated below, the bearing elements are separate bearing surfaces; however, the bearing elements can be bearing surface portions of an elongated bearing surface, or can take the form of other types of bearings (e.g., a roller bearing). The elongated body is attached to a mounting bracket, which is in turn attached to a steering column platform of the watercraft. The steering column platform can be part of the upper deck or can be a separate member attached to either the upper deck 16 or the lower hull 14. The bearing elements are located apart from each other by a sufficient distance along the longitudinal axis of the steering shaft to provide ample support for the steering column.

Figure 3:
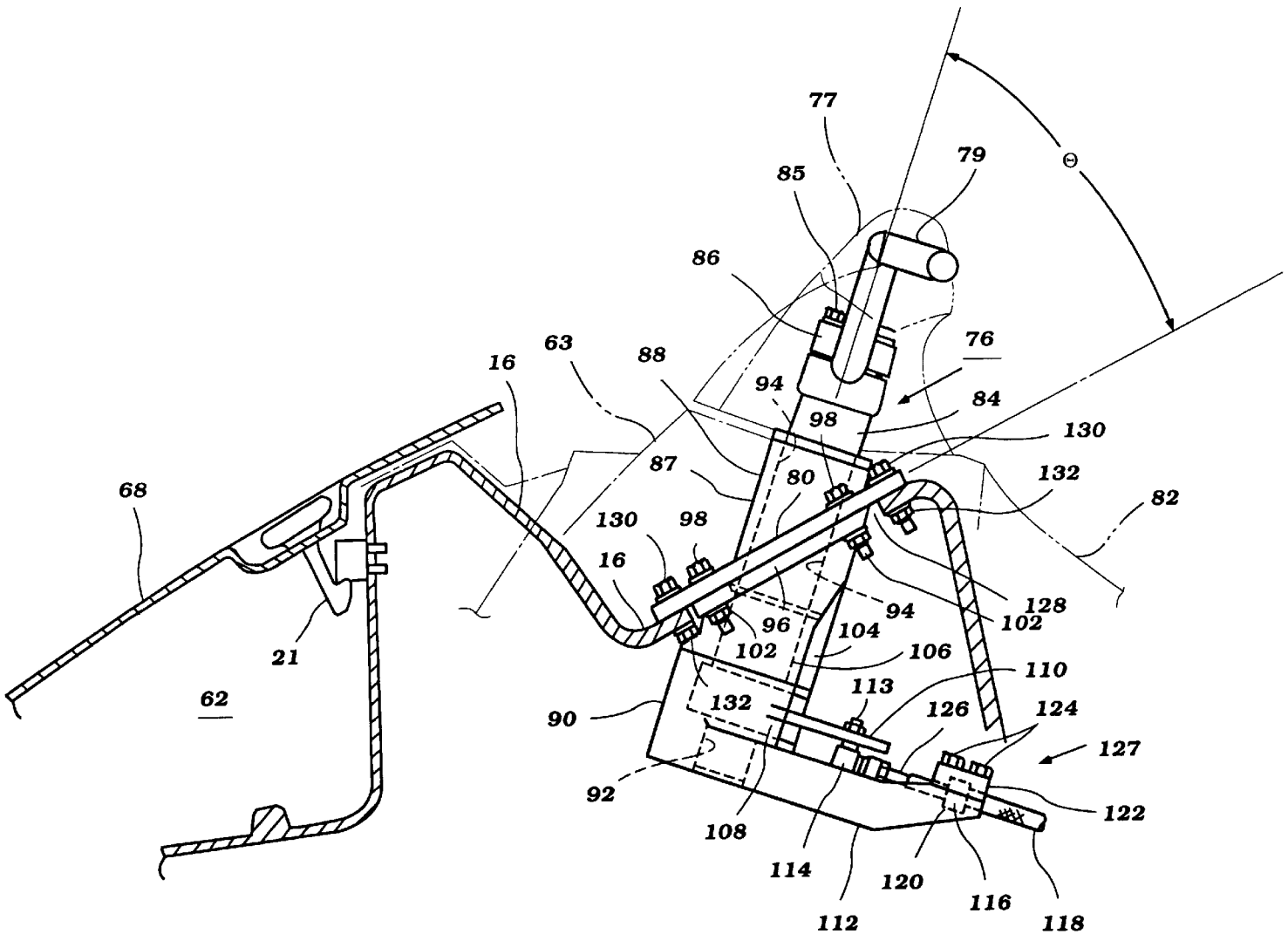
FIG. 3 is an enlarged sectional side view of the watercraft and illustrated steering operator mounting assembly of FIG. 1.
Figure 4:
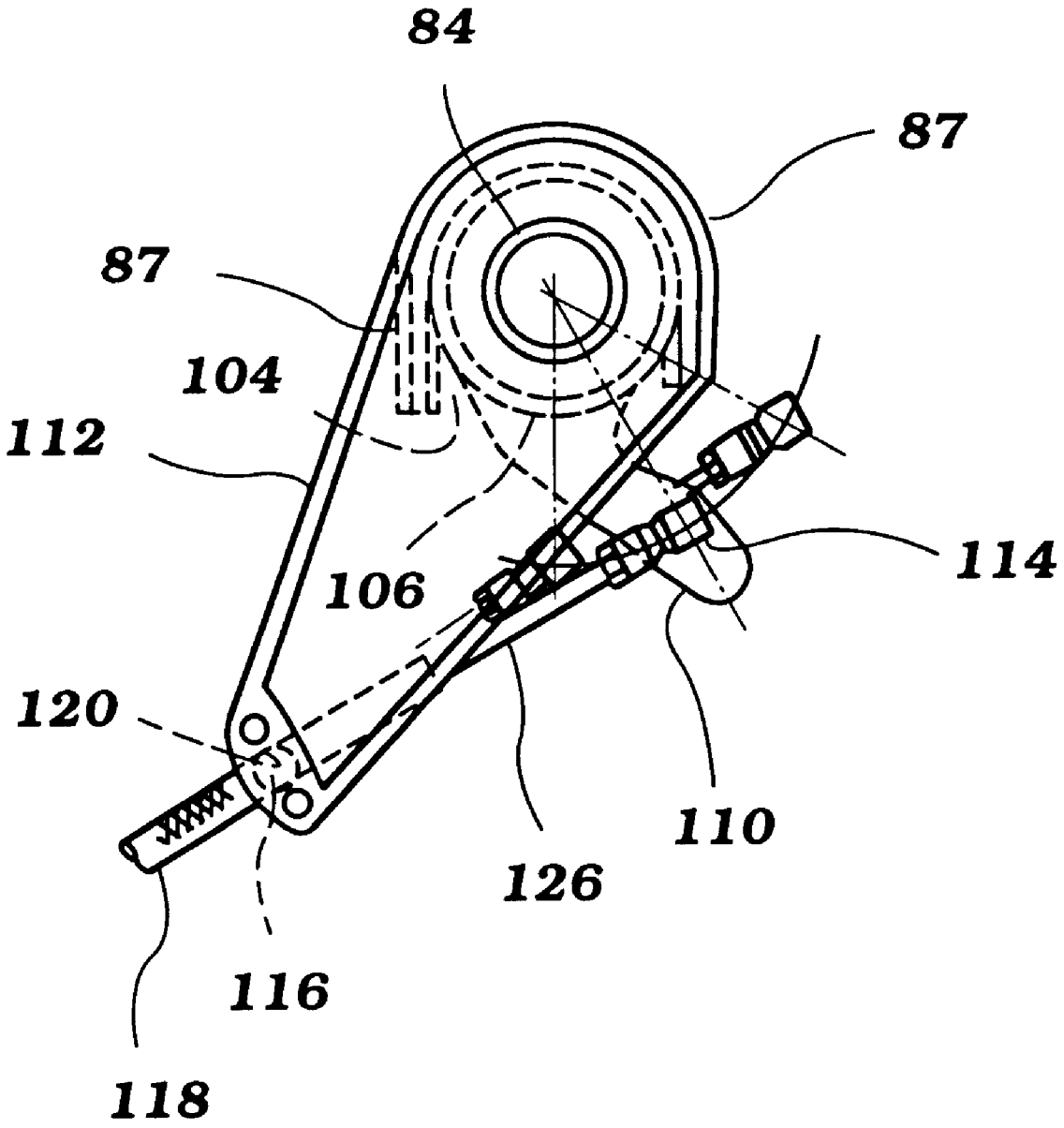
FIG. 4 is a top plan view of the steering operator mounting assembly of FIG. 3, showing a bowden-wire assembly attached to the mounting assembly.
Figure 5:
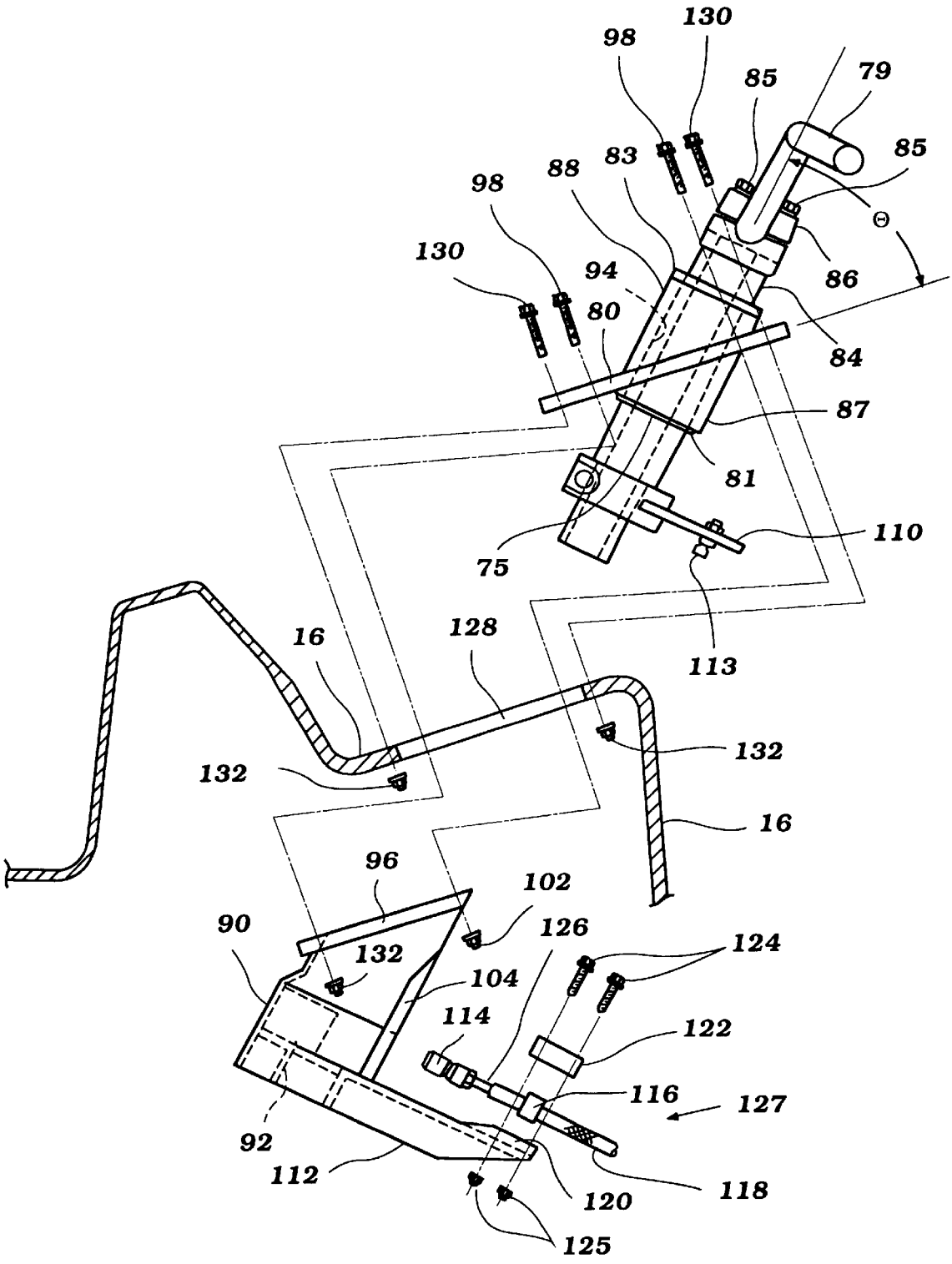
FIG. 5 is an exploded side view of the steering operator mounting assembly of FIG. 3.

In the embodiment disclosed in FIGS. 3–5, the steering operator mounting assembly 76 comprises handle bars 79 which are secured to a steering shaft 84 by a pair of handle brackets 86 and handle bolts 85. In the illustrated embodiment, the steering handle comprises handle bars. The steering shaft 84 extends through the elongated body, which in the illustrated embodiment is a cylindrical body 87.

A pad 77, formed of foam rubber or plastic, fits around the handle bars 79 and steering shaft 84, thereby protecting the driver of the watercraft from impact with the handle bars 79 and/or steering shaft 84, and improving the streamlined aesthetic appearance of the watercraft 10.

The cylindrical body 87 comprises an upper body 88 and a lower body 90, with the inner surface 94 of the upper body 88 being a substantially smooth bearing surface that allows the steering shaft 84 to smoothly rotate within the upper body 88. The lower body also has a bearing surface 92 that upports and allows the steering shaft 84 to rotate within the lower body 90. A steering flange 83 on the steering shaft 84 rests on top of the upper body 88, thereby preventing the steering shaft 84 from dropping through the upper body 88. A retainer ring 81 fits in a groove 75 in the steering shaft 84, at a location below the upper body 88, thereby preventing the steering shaft 84 from being lifted out of the upper body 88.

The upper body 88 is formed integrally with an upper mounting flange 80, or may be connected to the upper mounting flange 80 in a number of ways well known in the art, such as adhesive bonding, welding, or the like. In a similar manner, a lower attachment flange 96 is connected to the lower body 90.

As best seen in FIGS. 3 and 5, the upper mounting flange 80 is oriented at an angle θ relative to the longitudinal axis of the steering shaft 84, such that the upper mounting flange will rest flat against the surface of the upper deck 16 of the watercraft 10 when the steering operator is in its desired position. In the present embodiment, the upper mounting flange 80 is oriented approximately 45° relative to the longitudinal axis of the steering shaft 84. Similarly, the lower attachment flange 96 is oriented relative to the longitudinal axis of the steering shaft 84. The upper and lower flanges 80 and 96 are secured to each other by bolts 98 and nuts 102, or may be bonded together in a number of well known ways.

An opening 104 is formed in a portion of the lower body 90, exposing a lower section 106 of the steering shaft 84. A collar 108 is secured to the lower section 106, such that the collar 108 and lower section 106 rotate together. If desired, the collar 108 and lower section 106 may include interengaging structure such as a notch and key arrangement. An arm or lever 110 extends outward from the collar 108, through the opening 104 in the lower body 90. A terminal end fitting 114 of a steering cable 126 is rotatably secured to the arm 110 by a ball joint 113 or other means well known in the art. In the illustrated embodiment, the steering cable 126 is a bowden-wire having an inner wire that slides within an outer tubular casing.

A bracket 112 is formed unitary with the lower body 90, or can be connected to the lower body 90 in a number of ways well known in the art, such as adhesive bonding, welding, or the like. A stop 116, which circumscribes the casing 118 near its end, is positioned in a notch 120 in the bracket 112. The stop 116 is secured to the bracket 112 by a cap 122 and fastener (e.g., bolts 124 and nuts 125).

A steering unit opening 128 is formed in the upper deck 16 of the watercraft 10. This steering unit opening 128 is desirably smaller than the upper mounting flange 80, which allows the upper mounting flange to completely cover the steering unit opening 128. During assembly, the upper mounting flange 80 is secured to the upper deck 16 by one or more bolts 130 and nuts 132, or may be connected to the upper deck 16 by a number of other connecting methods, including adhesive bonding, welding, and the like. If desired, a sealant compound (not shown) such as silicone may be used to ensure a watertight seal between the upper mounting flange 80 and the upper deck 16.

The lower attachment flange 96 and associated components are then inserted into the watercraft hull through the access opening 107. The lower attachment flange 96 is then secured to the upper mounting flange 80 by bolts 98 and nuts 102. The steering shaft 84 is then inserted into the elongated body 87 and the collar 108 is attached to the steering shaft 84. The steering cable 126 is connected to the mounting assembly.

If desired, the steering unit opening may be formed large enough to permit the steering cable 126, bracket 112, lower body 90 and lower attachment flange 96 to pass through the steering unit opening 128. This would allow the steering operator mounting assembly to be completely assembled away from the watercraft, and then quickly installed into the watercraft hull with minimal assembly.

During operation of the watercraft, the watercraft driver will turn the handle bars clockwise or counterclockwise, depending upon the desired direction for the watercraft. This will cause the steering shaft to rotate, subsequently rotating the collar and arm. The movement of the arm will cause the fitting 114 of the steering cable to move relative to the stop 116, which will move the steering nozzle 32 of the watercraft 10, altering the direction of the watercraft 10 in a manner well known in the art.

The present invention also significantly reduces the amount of water contacting the components of the steering operator mounting assembly, and especially the steering cable components. As previously noted, steering cable components are especially susceptible to the corrosive effects of water and salt. By shielding the steering cable components from these corrosive elements, the present invention significantly improves the reliability of the watercraft steering system, and also significantly reduces maintenance requirements for these components. Moreover, the positioning of the bracket substantially shields the steering cable components from water in the watercraft hull and bilge.

FIGS. 6–8 and 9–10 illustrate steering operator mounting assemblies constructed in accordance with various additional embodiments of the present invention. Many of the basic components of these assemblies are the same between the embodiments. In order to ease the reader's understanding, like reference numerals with lettered suffixes are used to indicate like components between these embodiments.

Figure 6:
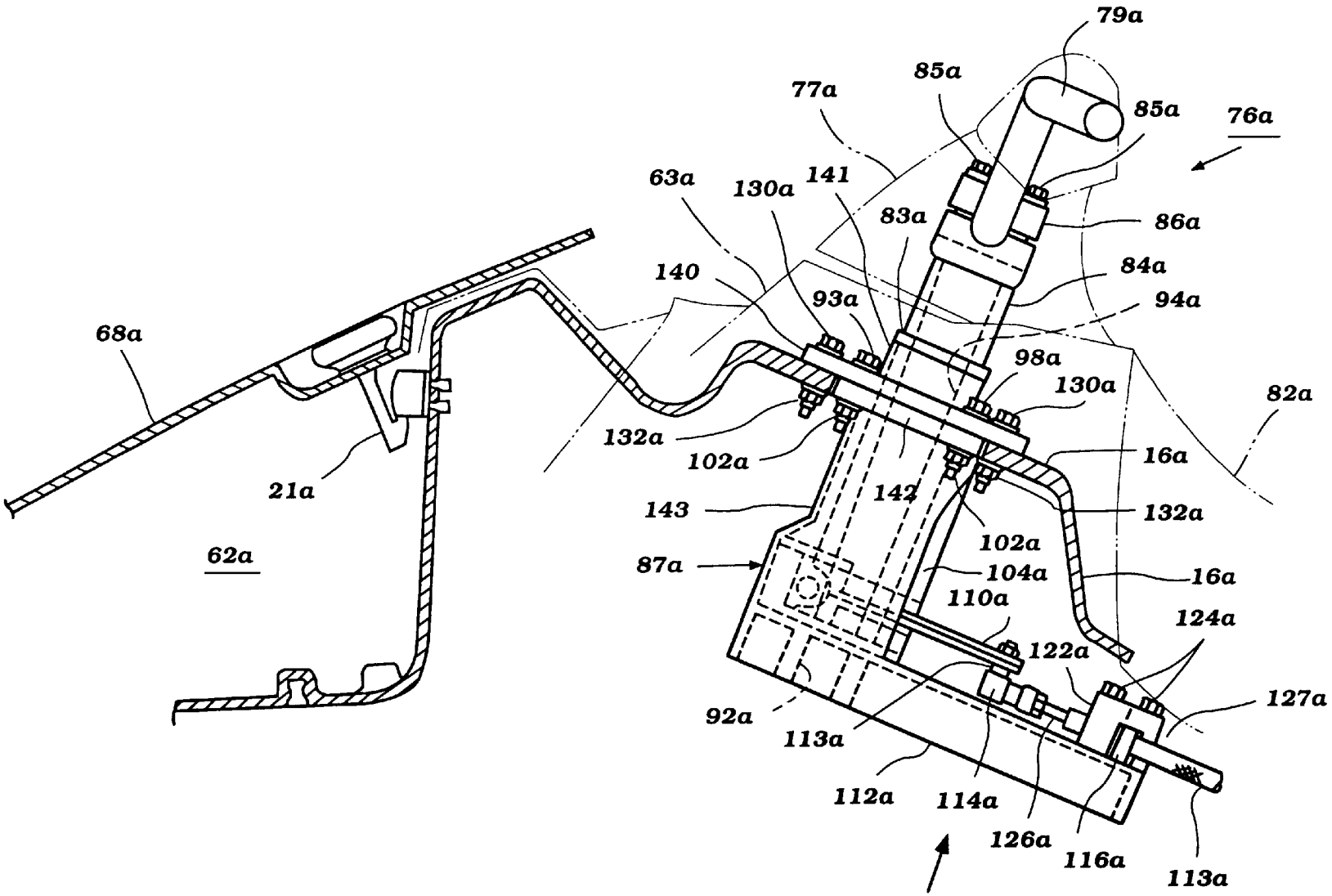
FIG. 6 is a partial sectional side view of a steering operator mounting assembly constructed in accordance with another embodiment of the present invention.
Figure 7:
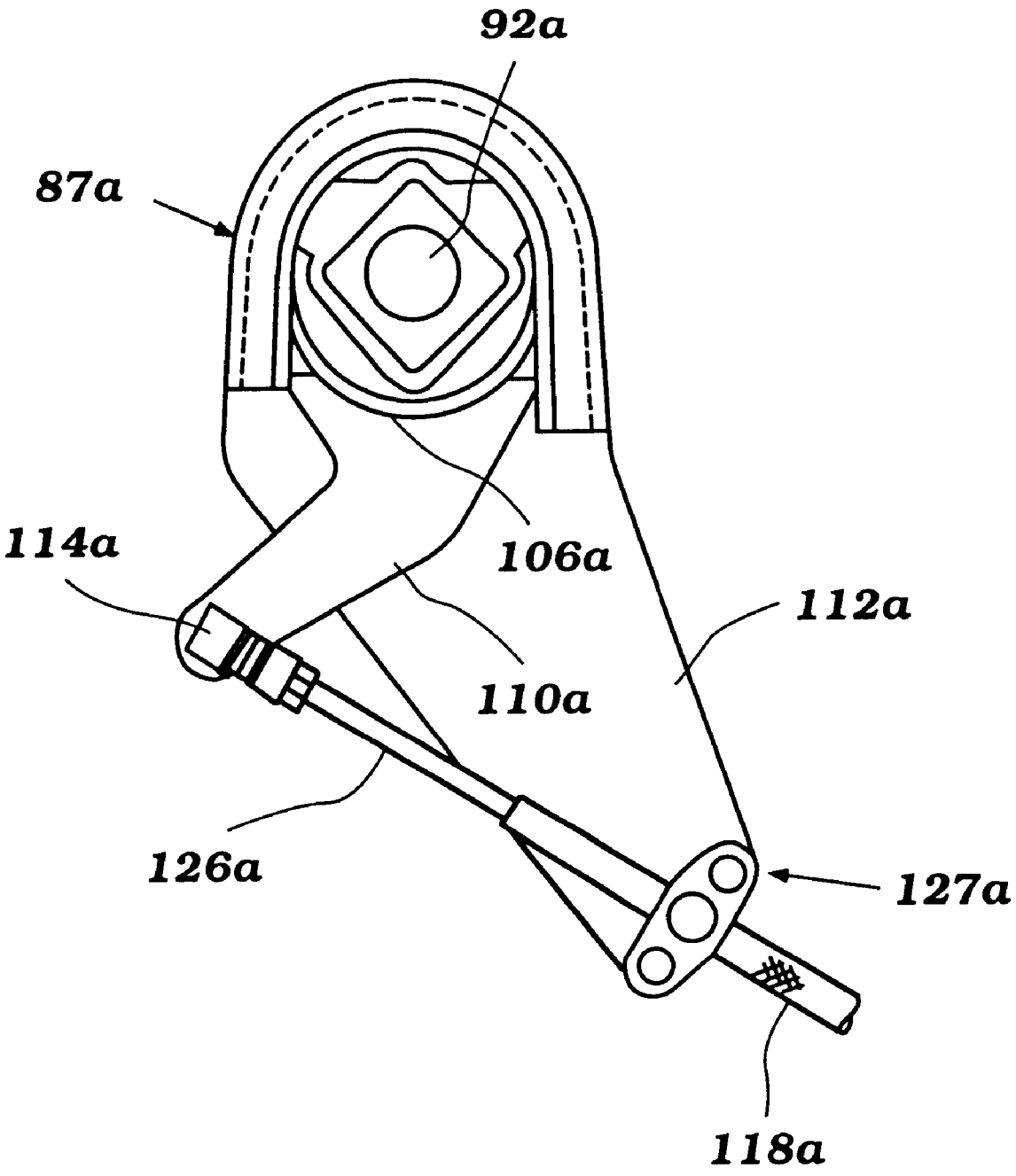
FIG. 7 is a top plan view of the steering operator mounting assembly of FIG. 6, showing a bowden-wire assembly attached to the mounting assembly.
Figure 8:
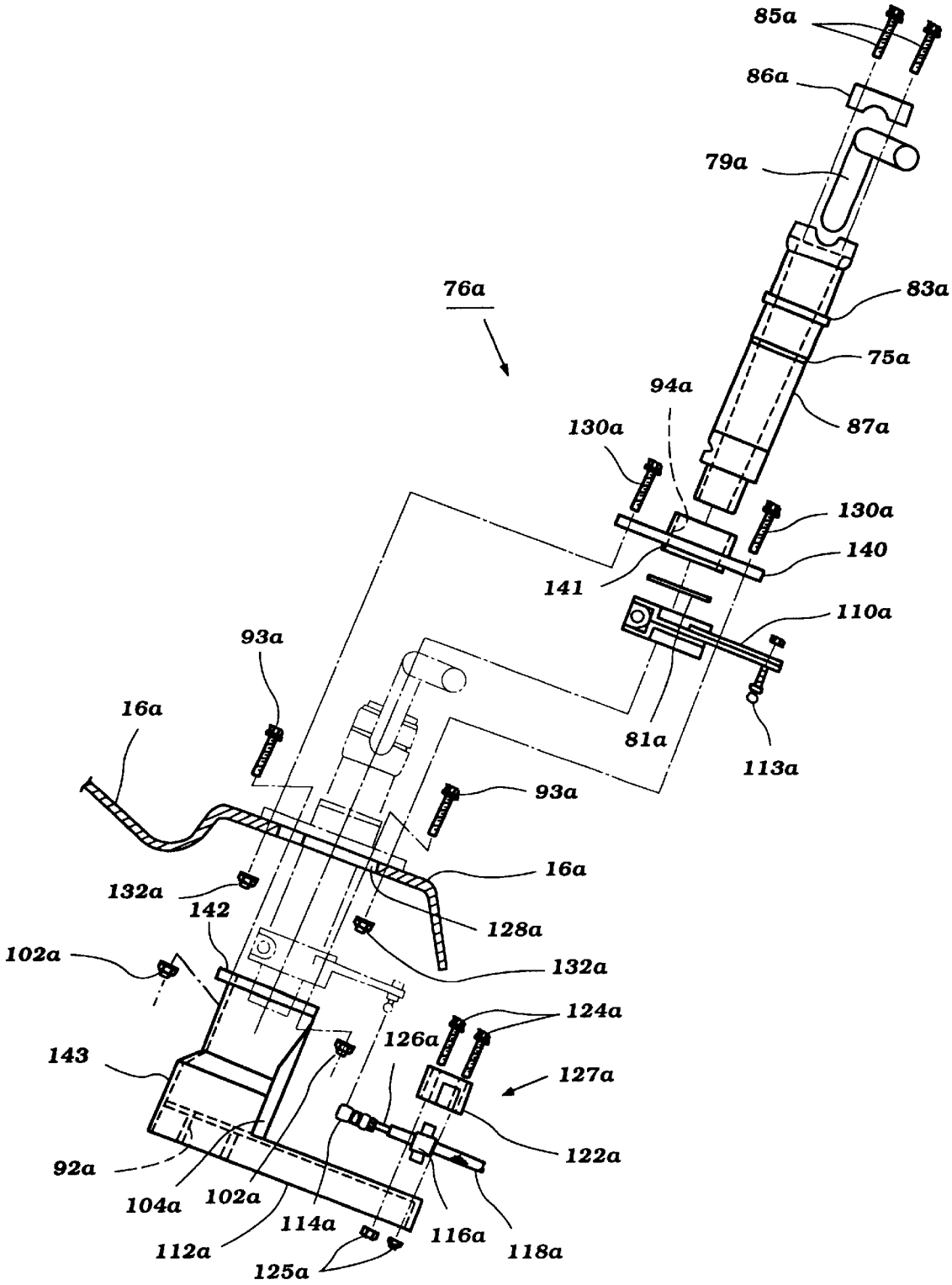
FIG. 8 is an exploded side view of the steering operator mounting assembly of FIG. 6.

FIGS. 6–8 depicts a steering operator mounting assembly constructed in accordance with an alternate embodiment of the present invention. The suffix "a" has been added to the like reference numerals to indicate like components between this embodiment and the one described above. In this embodiment, the steering operator mounting assembly **76*a* comprises upper and lower bodies 141 and 143 having upper and lower flanges 140 and 142 which are oriented perpendicular to the longitudinal axis of the steering shaft 87*a*. This embodiment allows the steering operator mounting assembly to be mounted to an upper deck 16*a* which is substantially horizontal. Furthermore, as best seen in FIG. 7**, the steering wire assembly may be routed along the opposite side of the watercraft engine, if desired.

In addition to the advantages previously discussed, the present embodiment significantly reduces the amount of material required for production of the upper and lower bodies and steering shaft, thereby lowering manufacturing and raw material costs. By shifting the orientation of the upper and lower flanges towards the horizontal plane, this embodiment permits the upper and lower bodies 141 and 143 to be substantially smaller than those disclosed FIGS. 3–5.

In addition, the present embodiment permits the steering shaft to be significantly shorter than previously disclosed in FIGS. 3–5. This greatly reduces the amount of interior hull-space required for proper operation of the steering assembly. Moreover, the present embodiment allows incorporation of the present steering operator mounting assembly into a watercraft having a substantially planar upper deck surface in front of the elongated seat. This further reduces the complexity of the hull design, and thereby reduces overall manufacturing costs for the watercraft.

Figure 9:
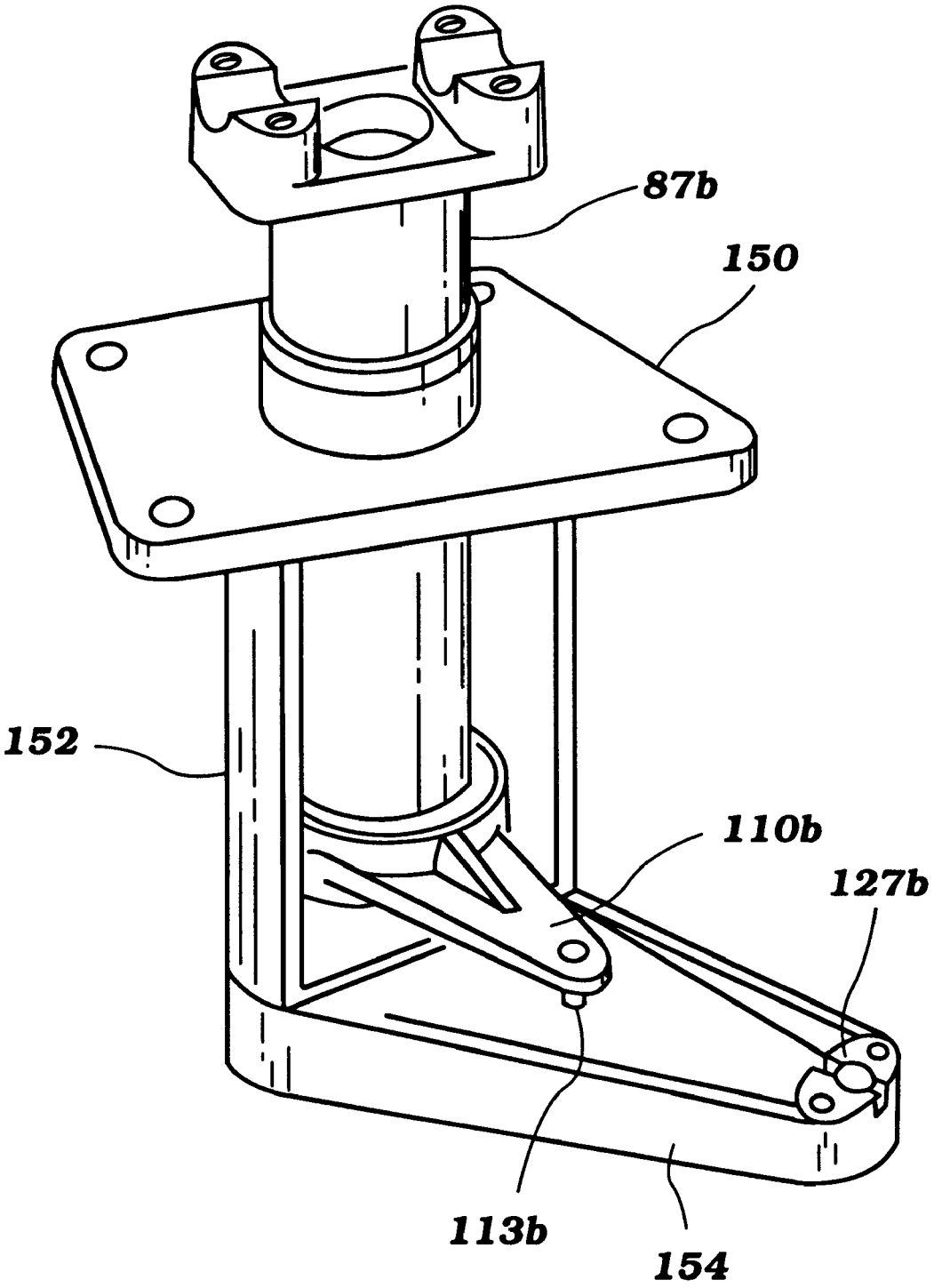
FIG. 9 is a perspective view of a steering operator mounting assembly constructed in accordance with an additional embodiment of the present invention.
Figure 10:
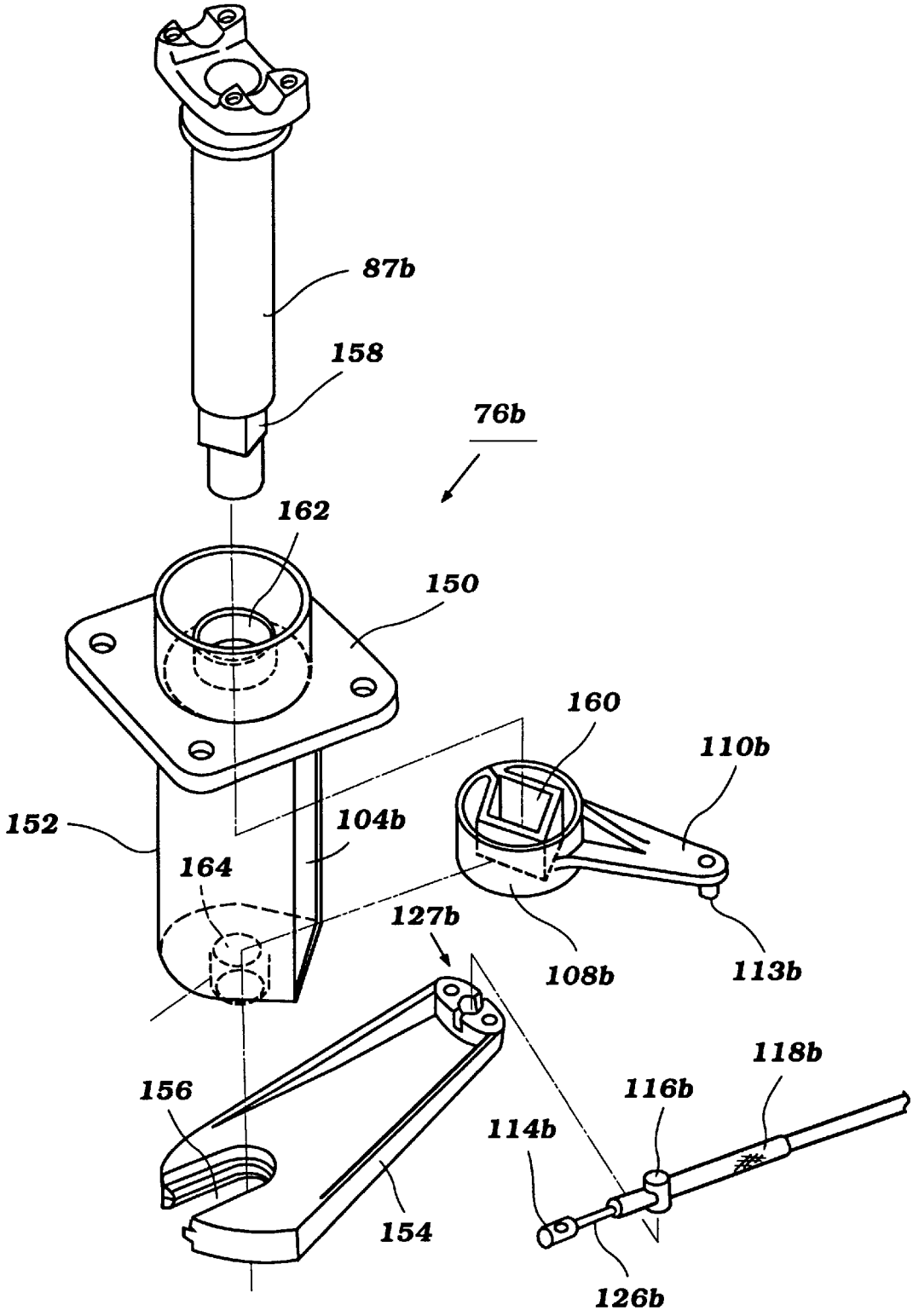
FIG. 10 is an exploded side elevational view of the steering operator mounting assembly of FIG. 9.

FIGS. 9 and 10 depict a steering operator mounting assembly constructed in accordance with an alternate embodiment of the present invention. The suffix "b" has been added to the like reference numerals to indicate like components between this embodiment and the one described above. In this embodiment, the steering operator mounting assembly 76*b* comprises an elongated body 152 having a mounting flange 150. Within the elongated body 152 is a cylindrical body 162 which supports and provides a smooth bearing surface for the steering shaft 87*b*. A lower bearing 164, located at the lower end of the upper body, rotatably supports the lower end of the steering shaft 87*b*.

At the lower end of the steering shaft 87*b*, a square cross-sectional portion 158 fits into a corresponding square cross-sectional opening 160 in the collar 108*b*, which prevents the collar 108*b* and the steering shaft from rotating relative to each other. A bracket 154, secured to the lower end of the elongated body 152 by a tongue-in-groove fitting 156 or other means (e.g., a snap fit), extends outward from the lower end of the elongated body 152, with the distal end of the bracket 154 securing the stop 116 of the steering cable 126*b*.

In addition to the advantages previously discussed, the present embodiment significantly reduces the number of component parts for the steering operator mounting assembly. Not only does this reduce the amount of material required for production of the mounting assembly, but it also significantly reduces the manufacturing complexity of the steering operator mounting assembly, thereby further reducing manufacturing costs.

Various components of the above described steering operator mounting assemblies can of course be incorporated into the other above-described embodiments. Thus, it should be understood that various features of several of the described embodiments could be combined while still embodying the present invention. For example, the elongated body can include an upper and a lower body, and the upper and lower bearing surfaces supporting the steering shaft can be incorporated into a single body, such as the upper body or the lower body, while adequately supporting the steering shaft.

In addition, although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a steering column platform and a mounting assembly for a steering shaft, the mounting assembly comprising an elongated body having an upper body and a lower body, the lower body coupled to the upper body, a first bearing element and a second bearing element, the first bearing element rotatably supporting the steering shaft within the upper body, the second bearing element rotatably supporting the steering shaft within the lower body and the second bearing element being distanced from the first bearing element, and an upper mounting flange attached to the elongated body, the upper mounting flange being mounted to the steering column platform.

2. The small watercraft of claim 1, wherein said first bearing element is located above said upper mounting flange, and said second bearing element is located below said upper mounting flange.

3. The small watercraft of claim 1, wherein said elongated body is a substantially cylindrical body.

4. The small watercraft of claim 1, wherein the flange is oriented perpendicular to a longitudinal axis of the elongated body.

5. The small watercraft of claim 1, wherein the flange is oriented obliquely relative to a longitudinal axis of the elongated body.

6. The small watercraft of claim 1, wherein the mounting flange is provided in the upper body, and the lower body is mounted to the upper body.

7. The small watercraft of claim 6, wherein the lower body includes a second mounting flange configured to mate with a lower surface of the mounting flange connected to the upper body.

8. The small watercraft of claim 7, wherein the upper body and the mounting flange are a unitary structure, and the lower body and the second mounting flange are a unitary structure.

9. The small watercraft of claim 8, wherein the upper and lower bodies and the respective flanges are formed of a moldable material selected from the group of fiberglass reinforced resin and thermoplastic.

10. The small watercraft of claim 1, wherein the first bearing element is above the steering column platform and the second bearing surface is below the steering column platform.

11. The small watercraft of claim 1, wherein the mounting flange forms a watertight seal with an upper deck.

12. A small watercraft including a mounting assembly for a steering shaft, the steering shaft having an arm mounted to a lower end of the steering shaft, the mounting assembly comprising an elongated body assembly having a mounting flange, the elongated body having an upper body and a lower body coupled together, a first bearing surface and a second bearing surface, the second bearing surface located below the flange and the arm of the steering shaft, the second bearing surface also being distanced from the first bearing surface, the bearings being arranged to rotatably support the steering shaft within at least a portion of the elongated body assembly, the flange being attached to an upper deck of the watercraft.

13. The small watercraft of claim 12 wherein the second bearing is located above the mounting flange.

14. The small watercraft of claim 12, wherein the mounting flange is generally perpendicular to the steering shaft.

15. The small watercraft of claim 12 wherein the upper portion and the lower portion are adapted to be positioned on opposite sides of an upper deck of the watercraft.

16. A small watercraft comprising a propulsion device, a steering element, and a mounting assembly for a steering shaft, the mounting assembly comprising an elongated body having a mounting flange, the elongated body having an upper body with a first bearing element and lower body with a second bearing element distanced from the first bearing element, the steering shaft having an arm mounted on a lower end of the steering shaft, one end of a steering wire attached to the arm, another end of the steering wire attached to the steering element of the watercraft, and opening disposed in the elongated body, the arm extending out through the opening, a bracket affixed to the elongated body, and an external casing of the steering wire attached to the bracket.

17. A small watercraft as in claim 16, wherein said bracket substantially shields said steering wire from water located in the bilge of said watercraft.

18. The small watercraft of claim 16, wherein the steering element is a steering nozzle pivotally supported behind the propulsion device.

19. The small watercraft of claim 16, wherein the steering wire is a bowden-wire cable.

20. The small watercraft of claim 16, wherein the bracket extends toward the steering element from the elongated body, the steering wire is mounted on an outer portion of the bracket distal of the elongated body assembly, and an access opening is provided in the upper deck at a location near the outer portion of the bracket.

21. A method of securing a steering shaft to an upper deck of a small watercraft comprising providing a mounting assembly having a first member and a second member, securing the steering shaft to the first member, placing the first member generally on an upper side of the upper deck and placing the second member within a hull of the small watercraft beneath the upper deck, coupling the first and second members together from opposite sides the upper deck, and supporting the steering shaft along its length with bearing elements of both the first and second members.

22. The method of claim 21 additionally comprising securing a steering cable to a lever projecting from the steering shaft, and arranging the lever to project through an opening in the second member.

23. The method of claim 22 additionally comprising fixing an outer sleeve of the steering cable to a portion of the lower member.

24. The method of claim 23, wherein the outer sleeve is fixed to an outer end of a bracket that is attached to and extends outward from a bearing housing of the lower member.

25. The method of claim 24 additionally comprising positioning the outer end of the bracket near an access opening formed in the upper deck of the watercraft hull.

26. The small watercraft of claim 25, wherein the steering element is a steering nozzle pivotally supported behind the propulsion device.

27. A small watercraft comprising a steering element, a steering column platform, a steering shaft and a mounting assembly for the steering shaft, the mounting assembly comprising of an elongated body having an upper body and a lower body, the lower body being coupled to the upper body, a first bearing element and a second bearing element, the first bearing element rotatably supporting the steering shaft within the upper body, the second bearing element rotatably supporting the steering shaft within the lower body, the steering shaft having an arm mounted to a lower end of the steering shaft, the arm of the steering shaft being coupled to the steering element, the arm of the steering shaft being located between the first bearing element and the second bearing element, and an upper mounting flange attached to the elongated body, the upper mounting flange being mounted to the steering column platform.

28. The small watercraft of claim 27 wherein the arm of the steering shaft is coupled to the steering element by a steering wire attached to the arm and another end of the steering wire attached to the steering element of the watercraft.

29. The small watercraft of claim 28 wherein there is an opening disposed in the lower body, the arm of the steering shaft extends out through the opening.

30. The small watercraft of claim 28 additionally comprising a bracket affixed to the lower body, and an external casing of the steering wire that is attached to the bracket, and wherein the bracket substantially shields the steering wire from water located in the bilge of said watercraft.

31. The small watercraft of claim 30, wherein the bracket extends toward the steering element from the lower body, the steering wire is mounted on an outer portion of the bracket distal of the elongated body assembly, and an access opening is provided in the upper deck at a location near the outer portion of the bracket.

* * * * *